United States Patent [19]

Negishi et al.

[11] 4,258,542

[45] Mar. 31, 1981

[54] BUNDLE OF FIBROUS ELEMENTS

[75] Inventors: Takao Negishi; Kazuo Tomiita, both of Otsu, Japan

[73] Assignee: Toray Industries, Inc., Tokyo, Japan

[21] Appl. No.: 940,437

[22] Filed: Sep. 7, 1978

[30] Foreign Application Priority Data

| | | | |
|---|---|---|---|
| Mar. 13, 1978 | [JP] | Japan | 53-27634 |
| Apr. 7, 1978 | [JP] | Japan | 53-40279 |
| Jun. 16, 1978 | [JP] | Japan | 53-72224 |
| Jul. 18, 1978 | [JP] | Japan | 53-87472 |
| Jul. 18, 1978 | [JP] | Japan | 53-87473 |

[51] Int. Cl.[3] ..... D02G 3/34

[52] U.S. Cl. ..... 57/206; 57/208

[58] Field of Search ..... 57/206, 208, 209, 317; 28/243; 264/167; 428/397, 399

[56] References Cited

U.S. PATENT DOCUMENTS

| | | | |
|---|---|---|---|
| 3,117,173 | 1/1964 | Adams | 57/206 X |
| 3,958,406 | 5/1976 | Corbiere | 57/206 |
| 4,043,108 | 8/1977 | Reese | 57/208 |
| 4,059,950 | 11/1977 | Negishi et al. | 57/247 X |
| 4,084,622 | 4/1978 | Makagawa et al. | 57/208 X |

*Primary Examiner*—Donald Watkins

*Attorney, Agent, or Firm*—Miller & Prestia

[57] ABSTRACT

Disclosed is a bundle of fibrous elements, at least some of which are uneven in the thickness in the axial direction thereof, namely some of which include thick portions having a larger sectional area and thin portion having a smaller sectional area. In these fibrous elements constituting the fibrous bundle, the thick portions have, in general, a higher dyeability than the thin portions, and in the fibrous bundle, these higher dyeability portions are formed substantially randomly at a distribution ratio of at least 300 portions per 10 cm of the length of the fibrous bundle. This fibrous bundle is characterized in that it apparently resembles a fibrous bundle composed of fibrous elements uniform in the thickness and dyeability. Also a process and apparatus for manufacturing such fibrous bundles are disclosed.

14 Claims, 23 Drawing Figures

BUNDLE OF FIBROUS ELEMENTS

BACKGROUND OF THE INVENTION (1) Field of the Invention

This invention relates to a fibrous bundle in which fibrous elements differing in characteristic features are mingled substantially uniformly. More particularly, the invention relates to a fibrous bundle composed of fibrous elements, at least some of them having a thickness varying along the lengthwise direction thereof, in which changes of characteristic features are due to variation of the thickness, and also relates to a method and apparatus for the production of such fibrous bundle.

By the term "fibrous bundle" used in the instant specification and appended claims are meant fibrous bundles of a great number of fibrous elements, such as a bundle of filaments, e.g., a multifilament yarn or tow, a bundle of staple fibers, e.g., a sliver, roving or spun yarn, and a bundle of filaments wherein parts or all of the bundle-constituting filaments involve broken points.

In this invention, fibrous elements of the fibrous bundle are elements of man-made fibers, which have been prepared from man-made fiber filaments.

(2) Description of the Prior Art

In general, a bundle of filaments is prepared from man-made fibers by spinning and drawing, and in ordinary filament bundles, all of bundle-constituting filaments are substantially uniform in the thickness and various characteristic features.

Also, fibrous bundles composed of filaments differing in characteristic features have been developed and proposed. These fibrous bundles are different from uniform filament bundles in various aspects.

These fibrous bundles, comprising in the mingled state fibrous elements differing in characteristic features, are roughly divided in two types. In one type, a plurality of groups of fibrous elements are mingled, and in respective groups, each of fibrous elements per se is provided with uniform characteristic features, although the characteristic features of fibrous elements of one group are different from those of fibrous elements of another group. In the other type, each of elements is provided with portions differing in characteristic features distributed in the lengthwise direction thereof.

The main difference between these two types of fibrous bundles is most conspicuous when fibrous elements differing in the stress-strain characteristics are mingled. When these fibrous bundles are drawn, in the former type fibrous elements having a low elongation are first broken and in the broken fibrous elements the positions of breakages thereof do not substantially differ in the fibrous bundle; whereas in the latter type, breakage is caused in portions of poor strength and the positions of breakage thereof are not uniform in the fibrous bundle. When it is intended to prepare a filament bundle resembling spun yarn by creating fluffs on a fibrous bundle, a fibrous bundle of the latter type is preferably employed.

Another difference is conspicuous when fibrous elements differing in the color effect or dyeability are mingled. In a fibrous bundle of the former type, fibrous elements of one group tend to gather with respect to the cross-section of the bundle so that uniform mingling of groups of fibrous elements in a cross-section of the bundle can not be attained. If uniform mingling is attained, fibrous elements of each group tend to gather during the processing. In the case where mingling of groups of fibrous elements with respect to the cross-section is not uniform, even if the thickness variation of the fibrous bundle along the lengthwise direction is substantially uniform, extreme unevenness of the color effects is manifested in a knitted or woven fabric formed from such fibrous bundle. In contrast, in the case of a fibrous bundle of the latter type, if the variation of the characteristic features of each fibrous elements are uniformly distributed with respect to the lengthwise direction thereof, uniform mingling with respect to the cross-section of the bundle can be created. However, it is very difficult to create such distribution of the characteristic features of fibrous elements that they are distributed uniformly in the lengthwise direction of the bundle.

In the case of mingling of fibrous elements differing in characteristic features other than the color effect or dyeability, a difference similar to that pointed out above with respect to mingling of fibrous elements differing in color effect or dyeability is observed between the two types of fibrous bundles. However, such difference is not so conspicous as in the case of mingling of fibrous elements differing in color effect or dyeability.

The present invention is related to a fibrous bundle of the above-mentioned latter type, in which differences of characteristic features are due to variations of thickness in each fibrous element.

Various fibrous bundles of the latter type are known. As methods for producing these fibrous bundles, there are known, for example:

- a method in which such factors as the draw ratio, the distance of the passage of the fibrous bundle the atmosphere of the passage of the fibrous bundle and resistance to the running fibrous bundle, etc, are changed at the spinning or drawing process;
- a method in which drawing is carried out at a draw ratio corresponding to a rate of elongation of the fibrous bundle in a constant tension elongation region;
- a method in which at the heat-drawing process, a fibrous bundle is drawn and heated for such a short time that respective fibrous dements are not uniformly heated, and;
- a method in which, before the drawing step, fibrous elements are scratched or deformed by a heat treatment, a coating treatment with a cracking agent or a treatment for forming slacks or rings in the fibous elements is performed, and then, the drawing operation is carried out.

In most fibrous bundles prepared according to the above-mentioned known methods, the distribution phase of the thick portions of respective fibrous elements are created uniformly along the lengthwise direction thereof in the case of cold drawing, and in case of heat drawing, portions having an intermediate thickness are formed in the respective fibrous elements so that the intended effects due to variations of the thickness are diminished. Further, in the case of cold drawing, from a technical point of view in the known art, it is clear that the number of thick portions (or thin portions) in the fibrous elements is increased, but the distribution state is not good and mingling of thin and thick portions is very uneven with respect to the lengthwise direction of the fibrous bundle. In the case of heat drawing, the distribution state is improved over the case of cold drawing, but the number of thick portions (or thin portions) cannot be increased and mingling of thick and thin portions is very uneven with respect to the lengthwise direction of the fibrous bundle.

SUMMARY OF THE INVENTION

The inventors of the present invention have found that, in preparing fibrous bundles composed of fibrous elements having portions diferring in thickness in the axial direction according to the above-mentioned conventional techniques, in order for fibrous bundles to be provided with uniform characteristic features with respect to the lengthwise direction thereof, the following two important requirements should be satisfied. Namely, there should be present a great number of thick portions (or thin portions) in respective fibrous elements and these thick portions (or thin portions) should be uniformly distributed in the bundle.

It is a primary object of this invention to provide a fibrous bundle composed of a plurality of fibrous elements having great numbers of thick portions and thin portions distributed uniformly in the fibrous bundle, which has a substantially uniform appearance as a whole.

Another object of this invention is to provide a fibrous bundle composed of filaments and/or staple fibers in the form of a multifilament processed yarn, a spun yarn, a roving, a sliver or a tow composed of crimped filaments, which is prepared from the above-mentioned fibrous bundle of fibrous elements by a heat treatment, a crimping treatment, a false-twisting treatment or a fluid treatment, and by optionally utilizing the fiber-cutting operation caused in the false-twisting treatment or fluid treatment or providing a step of cutting fibers as an independent step, and which comprises fibrous elements having a great number of thick and thin portions distributed in random condition and has a very uniform appearance as a whole.

By the term "fibrous bundles" used in the instant specification and appended claims is meant bundles composed of fibrous elements such as filament bundles, e.g., multifilament yarns and filament tows, bundles of staple fibers, e.g., slivers, rovings and spun yarns, bundles composed of filaments and staple fibers, and fibrous bundles where parts or all of filaments are cut.

Still another object of this invention is to provide a method and apparatus for the production of the above-mentioned fibrous bundles.

As pointed out hereinbefore, the fibrous bundle of this invention is composed of fibrous elements having uneven thicknesses. However, all of the fibrous elements constituting the fibrous bundle need not be uneven in thickness and parts of the fibrous elements may be uniform in the thickness.

The characteristic features of the fibrous bundle of this invention are as follows.

The fibrous bundle of this invention is composed of filaments and/or staple fibers, and parts or all of these fibrous elements constituting the bundle have a sectional area varying in the axial direction to form thick portions and thin portions. In general, thick portions have a higher dyeability than thin portions. These higher dyeability portions are dispersed and present at a distribution ratio of at least 300 portions per 10 cm of the length of the fibrous bundle.

In preparing the fibrous bundle of this invention composed of fibrous elements having uneven thickness, it is first of all important to recognize the peculiar thickness unevenness as mentioned above with respect to the primary object of this invention.

More specifically, the fibrous bundle of this invention is prepared according to a method characterized by the steps of: supplying a material fibrous bundle composed of fibrous filaments, each having a characteristic of constant tension elongation behaviour in a particular range of temperature, by a feed roller mechanism at a constant supplying speed; moving the fibrous bundle while it is being bent by contact with a frictional resistance-imparting member, and; taking up the fibrous bundle by a take-up roller at a constant speed to draw the fibrous bundle, the temperatures of members to be engaged with the fibrous bundle and the atmosphere of a drawing zone are maintained within said specific temperature range, the draw ratio expressed by (take-up speed)/ (feed speed) is made lower than the natural draw ratio of the filaments and the running fibrous bundle is caused to fall in contact with the take-up roller in the yarn passage at a point distant by 50 mm or less from the point where the fibrous bundle separates from the frictional resistance-imparting member. The fibrous bundle composed of fibrous elements having uneven thickness according to this invention can be advantageously prepared by this method.

The apparatus for producing the above-mentioned fibrous bundle composed of fibrous elements having uneven thickness according to this invention is characterized by a specific structure of the drawing mechanism. More specifically, in accordance with this invention, there is provided a fiber processing apparatus including a drawing device, this apparatus being characterized in that the drawing device comprises a frictional resistance-imparting member having a pin-like shape and a drawing roller, the central axis of the frictional resistance-imparting member having a pin-like shape is substantially parallel to the central axis of the drawing roller, and the following relationship is established between the frictional resistance-imparting member and the drawing roller:

$$d_3^2 + d_3(d_1 + d_2) \leqq 50^2 \quad (1)$$

wherein $d_1$ stands for the diameter (mm) of the frictional resistance-imparting member having a pin-like shape, $d_2$ stands for the diameter (mm) of the drawing roller, and $d_3$ stands for the distance (mm) between the drawing roller and the frictional resistance-imparting member.

Incidentally, the drawing roller mentioned above corresponds to the take-up roller described above with respect to the method. The above formula (1) also indicates that the drawing distance is very short and is 50 mm or shorter.

As discussed in detail hereinafter, by using the apparatus having the above-mentioned structure, there can be advantageously prepared a fibrous bundle having the above-mentioned characteristic features, namely, a fibrous bundle of fibrous elements having uneven thickness and including a great number of ordinarily higher dyeability thick portions dispersed and distributed uniformly in the fibrous bundle.

DETAILED DESCRIPTION OF THE PREFERRED EMBODIMENTS

[Fibrous bundle according to the present invention]

The fibrous bundle of this invention is a fibrous bundle composed of filaments and/or staple fibers in which parts or all of the fibrous elements constituting the bundle have uneven thickness along the axial direction thereof, as pointed out hereinbefore. Namely, the fibrous bundle of this invention is composed of fibrous elements having uneven thickness, i.e., including thin portions and thick portions. In General, the thick portions of the fibrous elements have a higher dyeability than the thin portions, and these high dyeability portions are present at a distribution ratio of at least 300 portions per 10 cm of the length of the fibrous bundle. The appearance of this fibrous bundle is not substantially different from the appearance of an ordinary fibrous bundle composed of uniform thickness fibrous elements, but the fibrous bundle of this invention has a peculiar feel to the hand or touch owing to the presence of thick and thin portions in the fibrous elements. Further, since a great number of thick portions are dispersed and distributed uniformly in random conditions, even if such thick portions existed in a fabric, dyeing unevenness that can be clearly identified by the naked eye is not caused.

In the fibrous bundle of the present invention, when high dyeability portions, i.e., thick portions, and thin portions are examined and analyzed in detail with respect to the formation state, that is, distribution state, it is found that the fibrous bundle of this invention has various characteristic features.

In the fibrous bundle of this invention, the state of distribution of the sectional areas of the constituent fibrous elements along the lengthwise direction of the fibrous bundle is of great significance. This will now be described in detail.

In order to analyze the state of distribution of the sectional areas of the constituent fibrous elements along the lengthwise direction of the fibrous bundle, it is necessary to cut the fibrous bundle at optional points and examine the cross-sections of respective fibrous elements on the respective cut sections of the bundle.

As described hereinbefore, in the fibrous bundle of this invention, thick portions of the fibrous elements have a higher dyeability than the thin portions, and the high dyeability portions are present at a distribution ratio of at least 300 portions per 10 cm of the length of the fibrous bundle. The thickness of the fibrous bundle as a whole is uniform in the lengthwise direction thereof, and it is preferred that the coefficient of variation of the number proportion of fibrous elements corresponding to high dyeability portions in the cut section of the fibrous bundle be less than 50%.

Figure 1:
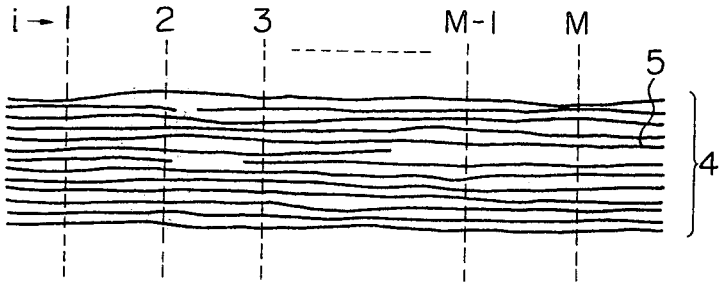
FIGS. 1 and 2 are diagrammatic views illustrating the method for analyzing the distribution of the section of fibrous elements constituting a fibrous bundle, which is adopted in this invention.

Referring to FIG. 1, in connection with a fibrous bundle 4 composed of fibrous elements 5, a predetermined number M of sections are examined. In order to obtain precise data, it is preferred that this number be large. In general, the number M should be at least 30, and in this invention, 50 sections are ordinarily examined with respect to the bundle. With respect to each section 1, 2, 3, . . . M, the number of fibrous elements 5 and the number of high dyeability portions 7, 8 present are examined. Based on these values, the number proportion $l_c$ of the high dyeability portions 7, 8 in the section of the fibrous bundle 4 is calculated according to the following formula:

$$l_c = L_c / N_c$$

wherein $N_c$ stands for the number of fibrous elements 5 observed in a certain section of the fibrous bundle 4 and $L_c$ stands for the number of high dyeability portions 7, 8 of which are observed in the section of the fibrous bundle 4.

Supposing that a symbol i is adopted for distinguishing a certain section from other sections (namely, i represents a value of from 1 to M; i=1, 2, 3, . . . M), the number proportion of the high dyeability portions 7, 8 in a certain section is expressed as $l_i$, the number of the fibrous elements observed in the certain section is expressed as $N_i$ and the number of the fibrous elements, the high dyeability portions 7, 8 of which are observed in the certain section, is expressed as $L_i$. In short, the number proportion $l_i$ is represented by the following formula:

$$l_i = L_i/N_i$$

This relation is illustrated in Table 1.

TABLE 1

| Number indicating section position in fibrous bundle | Number of fibrous elements observed in each section | Number of high dyeability portions observed in each section | Number proportion of high dyeability portions observed in each section |
|---|---|---|---|
| 1 | $N_1$ | $L_1$ | $l_1 = L_1/N_1$ |
| 2 | $N_2$ | $L_2$ | $l_2 = L_2/N_2$ |
| . | . | . | . |
| . | . | . | . |
| . | . | . | . |
| i | $N_i$ | $L_i$ | $l_i = L_i/n_i$ |
| . | . | . | . |
| . | . | . | . |
| . | . | . | . |
| M | $N_M$ | $L_M$ | $l_M = L_M/N_M$ |

The coefficient (%) of variation of the number proportion of the high dyeability portions in the section of the fibrous bundle is represented by the formula (2):

$$\left(\frac{\text{Standard Deviation of } l_i}{\text{Average Value of } l_i}\right) \times 100 = \frac{\sqrt{\dfrac{\sum_{i=1}^{M}\left(l_i - \dfrac{\sum_{i=1}^{M} l_i}{M}\right)^2}{M}}}{\dfrac{\sum_{i=1}^{M} l_i}{M}} \times 100 \quad (2)$$

In the fibrous bundle of this invention, it is preferred that this coefficient of variation of the number proportion of the high dyeability portions be less than 50%.

In the fibrous bundle of this invention, it is preferred that, when the distribution of sectional areas of fibrous elements constituting the fibrous bundle are examined by a histogram, two kinds of groups, namely the groups of the thick section portions and the thin section portions, can be clearly discerned from each other. This feature will now be described by reference to FIGS. 2, 3A and 3B.

Figure 2:
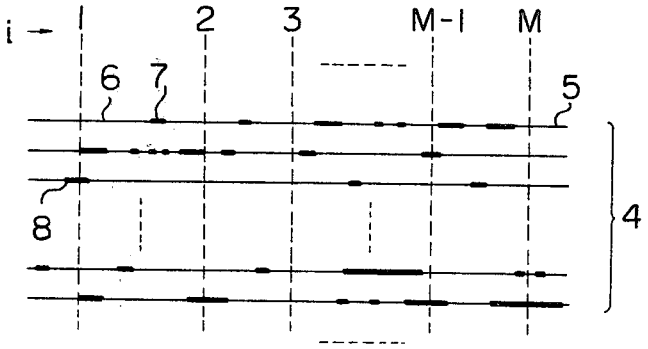

As in case of FIG. 1, a predetermined number M of sections of the fibrous bundle are examined, and if the total number of sections of fibrous elements present on each examined section of the fibrous bundle is $$N(N = \sum_{i=1}^{M} N_i)$$

and areas of these sections of the fibrous elements are examined, the above characteristic feature is manifested. In FIG. 2, a fibrous bundle 4 comprises fibrous elements 5 having thin portions 6 and thick portions 7 and 8. When the sections of respective fibrous elements are examined by a microscope or the like, it can be clearly discerned whether the observed sections are those of thick portions or those of thin portions. In other words, on a histogram of N of sectional areas (in FIGS. 3A and 3B the abscissa indicates the sectional areas of the fibrous elements and the ordinate indicates the frequency), these appear two peaks.

Such particular distribution of groups of thick section portions and thin section portions will now be described more mathematically.

Values of the sectional areas of fibrous elements on the examined section of the fibrous bundle are expressed by symbol A, and a number N of values A are arranged in order from a minimum value to a maximum value as follows.

$$A(K), [K = 1, 2, 3, \ldots N]$$

The average value of the sectional areas A(K) is expressed as B(1). Namely, B(1) is an average value of the sectional areas of N fibrous elements, which is calculated according to the formula:

$$B(1) = [A(1) + A(2) + A(3) + \ldots + A(N)]/N = \frac{\sum_{k=1}^{N} A(K)}{N}$$

An average value of sectional areas of groups of the same and largest possible numbers of sectional areas A(K) smaller than B(1) and sectional areas A(K) not smaller than B(1) is expressed as B(2). This value is calculated as follows.

If a maximum value among the sectional areas A(K) smaller than B(1) is designated as A(p), it is expressed as:

$$A(p) < B(1) \leqq A(p+1)$$

Since the number of sectional areas A(K) smaller than B(1) is p, the number of sectional areas A(K) not smaller than B(1) is (N−p). The number which is not larger in p and (N−p) is designated as Q. Namely, Q is expressed as:

$$Q = (N - |N - 2p|)/2$$

Based on the above-mentioned p and Q, B(2) is determined as follows:

$$B(2) = A(p-q+1) + \ldots + A(p) + A(p+1) + \ldots + A(p+Q)/2Q$$

The above formula indicates that in values A(K) arranged in order from a minimum value to a maximum value, the above average value B(1) is presented between the p-th value A and the (P+1)-th value a or the (p+1)-th value A is equal to B(1), and Q represents the above-mentioned same and maximum numbers, and also that B(2) is an average value of Q of values A smaller than B(1) as the boundary and Q of values A not smaller than B(1), namely an average value of 2Q's of values A.

In the same manner as B(2) is calculated from B(1), B(3) is then determined while the average value of 2Q's of values A is regarded as B(2). Similarly, B(4), B(5), . . . are determined in succession and the convergent value (or the medium value when the above values do not converge but indefinitely diverge) is designated as B. If the value of Q at this value B is larger than 1, the value B is significant and is designate "boundary sectional area value" in the instant specification. A group of fibrous elements having sectional area values A(K) smaller than B is designated as a group of thin section portions and a group of fibrous elements having sectional area values A(k) not smaller than B is designed as a group of thick section portions. When B is thus determined with the value Q being larger than 1, it can be said that groups of thick section portions and thin section portions are distributed in the discernible condition from each other.

In the fibrous bundle of this invention where the sectional area can be clearly discerned into groups of thin section portions and thick section portions are described above, if the distribution of sectional areas of the fibrous elements constituting the fibrous bundle is such that the number of the fibrous elements having a sectional area within the range of from the value of [(boundary sectional area value)+(average value of sectional areas in group of thick section portions)]/2 to the value of [(boundary sectional area value)+(average value of sectional areas in group of thin section portions)]/2 does not exceed 10% of the total number of the fibrous elements, the thin-thick effect is further enhanced and a product, according to the present invention, having better properties is obtained.

In the fibrous bundle of this invention, it is important that distribution of sectional areas of constituent fibrous elements is such that groups of thick section portions and thin section portions (hereinafter referred to as "thick and thin groups") are distributed in a discernible condition from each other, as pointed out hereinbefore. The above-mentioned preferred distribution state will now be described in detail. The average values of the sectional areas of the thin and thick groups are designated as $A_S$ and $A_L$, respectively, and these are expressed as:

$$A_S=[A(1)+A(2)+\ldots+A(p)]/p$$

$$A_L=[A(p+1)+A(p+2)+\ldots+A(N)]/(N-p)$$

It is preferred that the number of the fibrous elements having a sectional area within the range of from $[(B+A_L)/2]$ to $[(B+A_S)/2]$ does not exceed 10% of the total number of the fibrous elements. In other words, the following distribution states are excluded from the preferred distribution state of this invention. Namely, distribution states where: large quantities of portions having an intermediate thickness or sectional area are present; fibrous element portions of the thick group and/or thin group are distributed with a gentle distribution curve; a majority of fibrous element portions are included in the thick group or thin group alone; the ratio of the $A_S$ and $A_L$ values is small; the thickness of the boundary portion between a thick portion 7 or 8 and an adjacent thin portion 6 in FIG. 2, namely fibrous element portions having an intermediate thickness varying gradually for a long distance, or the sectional ratio between a thick portion 7 or 8 and an adjacent thin portion 6 is fairly large and, therefore, a boundary portion therebetween broadly extends, and the number of boundaries between the thick portions 7 or 8 and the thin portions 6 is so large that the intended thick-thin effect of this invention cannot be attained.

Figure 3A:
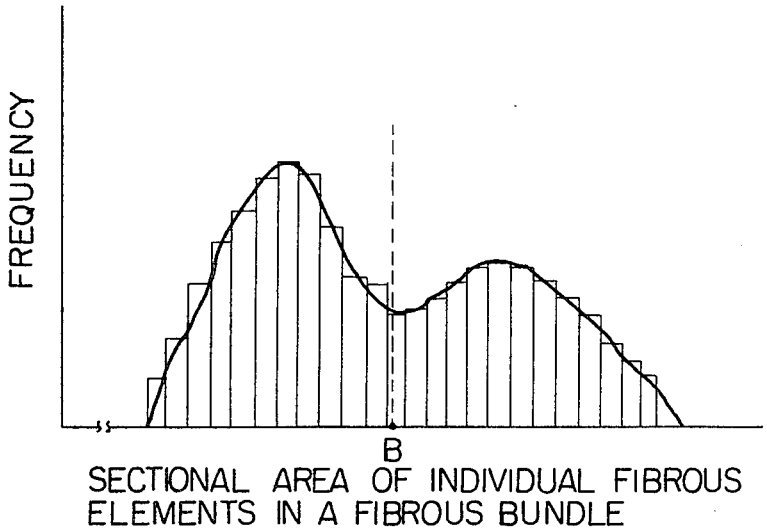
FIGS. 3A and 3B are graphs showing distribution histograms (the ordinate indicates the frequency and the abscissa indicates the sectional area) regarding the sectional areas of individual fibrous elements in the fibrous bundle according to the present invention.
Figure 3B:
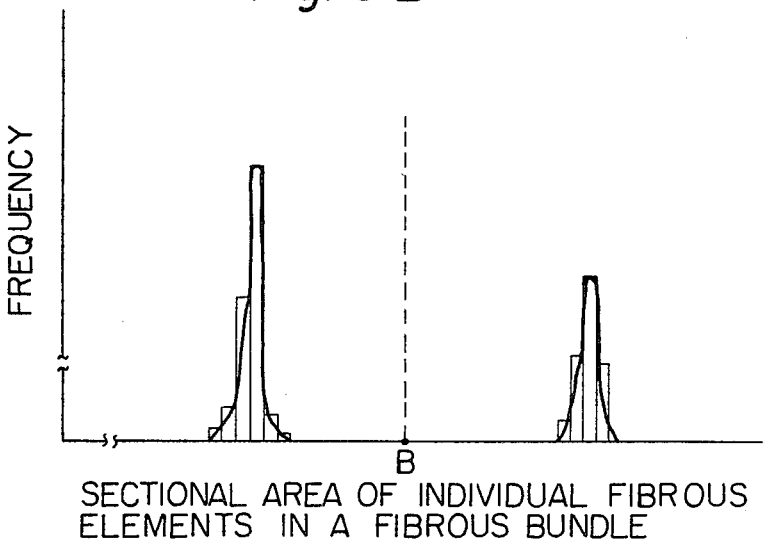

Histograms of the sectional areas of the fibrous elements in the fibrous bundle of this invention having the above-mentioned distribution characteristics are diagrammatically illustrated in FIGS. 3A and 3B.

FIG. 3B shows diagrammatically a pattern of the distribution state of sectional areas of fibrous elements in a certain section of a fibrous bundle obtained by the particular drawing operation adopted in this invention, which will be described hereinafter; FIG. 3A shows diagrammatically a pattern of the distribution state of sectional areas of fibrous elements in a certain section of a fibrous bundle obtained by false-twisting the fibrous bundle shown in FIG. 3B.

In the fibrous bundle of this invention where groups of thick sectional area portions and thin sectional area portions are involved in discernible condition it is preferred that the coefficient of variation of the number proportion of the fibrous elements included in the thick group be less than 50%.

The above-mentioned coefficient of variation is determined according to a method similar to the above-mentioned method for determining the coefficient of variation of the number proportion of the high dyeability portions. Further, from the viewpoint of mingling of the thick and thin groups, it is particularly preferred that the number of the fibrous element portions of the thick group be 10 to 70% of the total number of the fibrous element portions present on a certain section of the fibrous bundle. Namely, it is preferred that when the section of the fibrous bundle including N number of fibrous element portions is analyzed as described above, N/10 to 7/10×N of fibrous element portions are included in the thick group. In other words, it is preferred that the relation of $$0.1 < \frac{N-p}{N} < 0.7$$

be established.

In the fibrous bundle of this invention, when the sectional areas of fibrous element portions present in a certain section of the fibrous bundle are distributed so that the following relation is established:

$$1.3 \leqq \frac{\text{Average value } A_L \text{ of sectional areas in thick group}}{\text{Average value } A_S \text{ of sectional areas in thin group}} \leqq 2.2$$

the difference of the sectional areas of the fibrous elements on said section of the fibrous bundle is not too conspicuous, but moderate and good results can be obtained.

In this invention, when fibrous elements constituting the fibrous bundle are crimped by the false-twisting treatment, there can be obtained a fibrous bundle having excellent bulkiness.

The crimping effect will now be discussed. Generally speaking, crimps formed on fibrous elements are elongated under a tension, and it often happens that crimps overlap one another among crimped fibrous elements and no substantial bulkiness is manifested in a fabric composed of these crimped fibrous elements. The phenomenon is observed frequently when the thickness of fibrous elements is uniform among fibrous elements constituting a fibrous bundle. In the case of a fibrous bundle composed of fibrous elements having uneven thickness, such as the fibrous bundle of this invention, the following particular effects can be attained when crimps are formed on constituent fibrous elements by false-twisting.

The first effect created by the above-mentioned false-twisting treatment is that the size of crimps formed by false-twisting becomes irregular and overlapping of crimps are prevented, whereby the bulkiness is improved.

The second effect is that the sectional shapes of thick portions of fibrous elements are flatter or more curved than those of thin portions of fibrous elements, and therefore, spaces are formed among the fibrous elements and the bulkiness is increased.

The third effect is that the unevenness of tensile strength in the longitudinal direction thereof is produced by the uneven thickness and, hence, a bundle of filaments having the above-mentioned characteristics can easily be converted to a bundle of staple fibers or a multifilamentary bundle having fluffs, namely a bundle of fibrous elements having an enhanced bulkiness.

The above-mentioned three effects can be attained especially conspicuously when phases of uneven thickness among fibrous elements along the lengthwise direction thereof are very irregular. The number of thick and thin portions formed in respective fibrous elements is very large and the fibrous bundle as a whole is substantially uniform.

In a fibrous bundle which has passed through the false-twisting treatment, sectional shapes of constituent fibrous elements are flattened. In the fibrous bundle of this invention, even after the false-twisting treatment, the sections of thick portions of fibrous elements can be discriminated from those of thin portions of fibrous elements, and in general, the degree of flattening of the cross-section of fibrous elements is higher in the thick portions than in the thin portions. As pointed out hereinbefore, groups of thick sectional area portions and thin sectional area portions are distributed in discernible condition in the fibrous bundle of this invention. Accordingly, if the degree of flattening of the cross-section of the fibrous elements is analyzed with respect to N number of sections of fibrous elements, the degree of flattening in the thick group can also be clearly discerned from the degree of flattening in the thin group with respect to the distribution state. More specifically, according to a method similar to the above-mentioned method for determining the boundary value of the sectional area (the boundary sectional area value), maximum diameters D of sectional shapes of N number of fibrous element sections are arranged in order from the smallest value to the largest value as follows:

$$D(K),(K=1, 2, 3, \ldots N)$$

and the boundary maximum diameter value can be determined.

Figure 4:
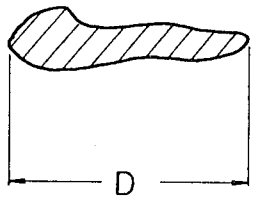
FIG. 4 is a sectional view of a fibrous element wherein the "maximum diameter" thereof is particularly indicated.

By the term "maximum diameter D" used herein is meant a maximum width conceivable in the sectional shape of the fibrous element as shown in FIG. 4.

The boundary maximum diameter value can thus be determined in the same manner as the boundary sectional area value is determined. In this invention, a portion of a fibrous element having a section of a maximum diameter value not smaller than the boundary maximum diameter value is called a "flat section portion". In the fibrous bundle of this invention, which is composed of fibrous elements crimped by the false-twisting treatment, from the viewpoints of the thick-thin distribution state and the mingling effect, it is preferred that when the sectional shapes of the fibrous elements are analyzed, the number of fibrous element portions having a flat section be larger than 10% of the total number of fibrous element sections.

In the above-mentioned fibrous bundle composed of crimped fibrous elements, in order to attain a further increased bulkiness, it is most preferred that the constituent fibrous elements be entangled with one another intermittently along the lengthwise direction of the fibrous bundle. Namely, a fibrous bundle having entangled portions and non-entangled portions appearing alternately along the lengthwise direction of the fibrous bundle is most preferred. From the viewpoint of the bulkiness, it is preferred that at least 30 entangled portions appear per meter of the length of the fibrous bundle.

In the case of a fibrous bundle composed of fibrous elements crimped by the false-twisting treatment, when it is intended to impart a gathering property to the fibrous bundle, fusion bonding of the constituent fibrous elements, or true twisting or alternate twisting is performed. Thus, a continuous or intermittent gathering property can be imparted to the fibrous bundle.

In the case of a fibrous bundle composed of fibrous elements crimped by the false-twisting treatment, if the difference of strength or elongation is caused between the thick portion and thin portions of the fibrous elements, it sometimes happens that breakages of fibrous elements are caused at random positions in the fibrous bundle at the step of untwisting the false twists. In this case, the fibrous bundle includes crimped fibrous elements having cut ends. In such a fibrous bundle, from the viewpoint of the appearance or feel to the hand, it is preferred that at least 10 of cut ends be present per meter of the length of the fibrous bundle. In this case, there can be obtained a good fibrous bundle having an appearance and feel to the hand quite similar to those of a spun yarn.

Figure 5:
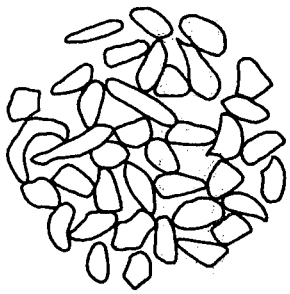
FIG. 5 is a sectional view of a fibrous bundle of this invention which is composed of fibrous elements having crimps formed by the false-twisting treatment.
Figure 6:
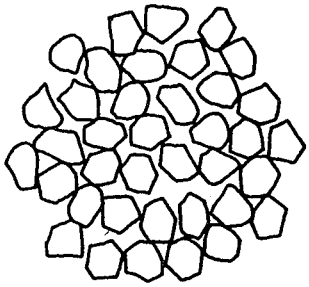
FIG. 6 is a sectional view of a fibrous bundle prepared by false-twisting a conventional fibrous bundle composed of fibrous elements having uniform thickness.

The section of a fibrous bundle composed of fibrous elements crimped by the false-twisting treatment according to this invention is illustrated in FIG. 5. For comparison, the section of a fibrous bundle composed of fibrous elements uniform in the thickness, which have been crimped by the false-twisting treatment, is illustrated in FIG. 6.

[Method according to the present invention]

In connection with the production method, in this invention it is, first of all, important to produce a fibrous bundle composed of individual filaments having thick portions and thin portions, and hence, being uneven in thickness along the longitudinal direction thereof. The thick portions generally have a higher dyeability than the thin portions and the high dyeability portions are present at a distribution ratio of at least 300 portions per 10 cm of the length of the fibrous bundle. This fibrous bundle is prepared according to the following method, adopting specific conditions at the drawing step.

More specifically, the method of this invention is characterized in that: a fibrous bundle of filaments having such a charactristic feature as a constant tension elongation behavior under a processing condition of specific temperature range is supplied at a constant speed from a feed roller, and then, the fibrous bundle is drawn while being bent by contact with a frictional resistance-imparting member and the fibrous bundle is taken up by a take-up roller at a constant speed in such condition that, the temperatures of members to be engaged with the fibrous bundle and the atmosphere of a drawing zone are maintained within a predetermined temperature range, the draw ratio expressed by (take-up speed)/(feed speed) is made lower than the natural draw ratio of the filaments and the running fibrous bundle is caused to fall in contact with the take-up roller in the yarn passage at a point distant by 50 mm or less from the point where the fibrous bundle separates from the frictional resistance-imparting member.

By the term "constant tension elongation behavior" referred to in this specification is meant the following drawing behavior.

When a filament or a bundle of filaments is statically drawn in a constant temperature atmosphere, the tension acting on the filament or bundle is first increased as the drawing operation proceeds, and then, the tension is decreased. If the drawing operation is carried out further, the filament or bundle is drawn while the tension is maintained substantially at the same level for a certain length of time. The above-mentioned change of the filament's tension is hereinafter refered to as a tension change in a first condition. If the drawing operation is carried out further, the tension is increased again, and finally, a filament or a bundle of filaments is broken. The above-mentioned change of the filament's tension is hereinafter referred to as a tension change in a second condition.

By the term "natural draw ratio" is meant a draw ratio corresponding to a filament's tension in the above-mentioned second condition which is equal to a maximum filament tension in the above-mentioned first condition.

By the term "a predetermined temperature range" is meant a range of temperatures where a filament or a bundle of filaments shows the above-mentioned constant tension elongation behavior.

Figure 7:
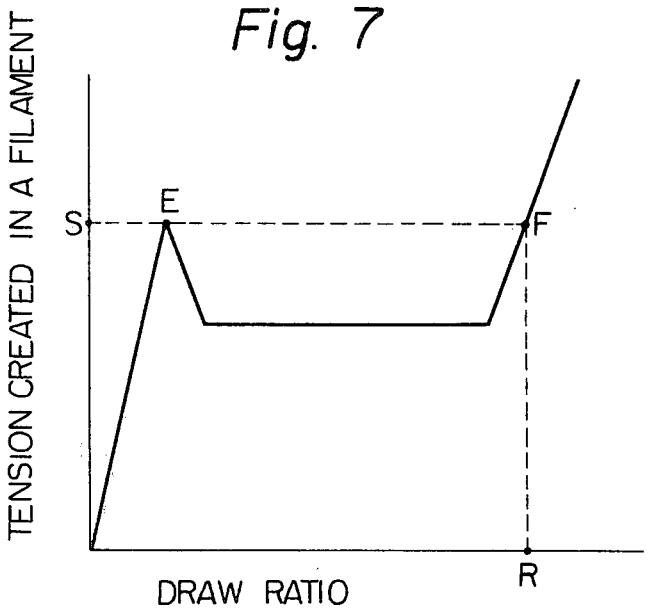
FIG. 7 is a diagram illustrating a typical characteristic curve indicating the relationship between the tension and draw ratio when thermoplastic undrawn filaments are statically drawn in a constant-temperature atmosphere. Incidentally, fibrous elements showing an elongation behavior as shown in FIG. 7 are fibrous elements provided with the characteristic of "constant tension elongation behavior" referred to in this invention.

FIG. 7 shows typical example of the tension-draw ratio characteristic curve obtained when a thermoplastic undrawn filament is statically drawn in a constant temperature atmosphere. Referring to FIG. 7, when an undrawn filament is drawn, the tension created in the filament is increased to the point E and is then decreased. The filament is drawn for a certain length of time while the above-mentioned tension is maintained substantially at the same level and, when drawing is carried out further, the tension is increased again and passes through the point E, and finally, the filament is broken. Even if the tension is released midway in the above-mentioned drawing operation, the length of the drawn filament is larger than the original length, and it is understood that plastic deformation has been caused. Accordingly, it can be said that the filament displays the constant tension elongation behavior defined above. The point F is a point where the tension is equal to tension S at the point E, and the draw ratio R at the point F is the inherent natural draw ratio. The point E is the drawing initiating point and the tension S is the drawing initiating tension.

In the production method of this invention, a fibrous bundle of filaments is introduced from an appropriate supply source such as a filament package or the spinning step, and it is processed while it is engaged in succession with a feed roller, a frictional resistance-imparting member and a take-up roller. Yarn guides and other members are appropriately inserted. The processing operation is carried out at a substantially constant running speed under fixed conditions.

In the method of this invention, the processing is carried out under such conditions that temperatures of members to be contacted with the fibrous bundle of filaments (especially, the frictional resistance-imparting member and take-up roller) and the atmosphere in the drawing zone are maintained within the specific temperature region allowing the above-mentioned constant tension elongation behavior and the draw ratio (take-up speed/feed speed) of the filaments at the above-mentioned temperature is lower than the natural draw ratio.

In the case of polyolefins such as polyethylene and polypropylene, polyamides such as nylon 6 and nylon 66, polyesters such as polyethylene terephthalate, and copolymers, mixtures and composites composed mainly of these polymers, in general, fibrous elements having a low degree of molecular orientation, display the constant tension elongation behavior.

Figure 8:
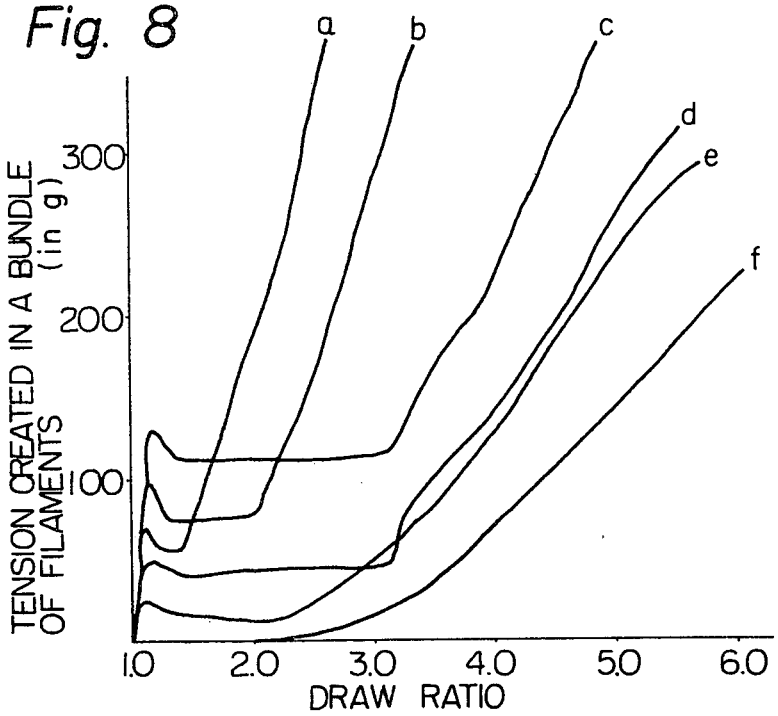
FIG. 8 is a diagram illustrating the characteristics of the tension-draw ratio regarding the fibrous bundles of undrawn fibrous material formed by melt-spinning polyethylene terephthalate at various spinning speeds.

Tension-draw ratio characteristics under static drawing of fibrous bundles of 36 filaments (so-called multifilament yarn) formed by melt-spinning polyethylene terephthalate at various spinning speeds are shown in FIG. 8.

Natural draw ratios, as measured at an atmospheric temperature of 25° C., of these fibrous bundles melt-spun at various spinning speeds are shown in Table 2.

TABLE 2

| Spinning Speed (m/min) | Natural Draw Ratio | Thickness (denier) of undrawn Fibrous Bundle | Curve in FIG. 8 |
|---|---|---|---|
| 1000 | 3.2 | 240 | c |
| 2000 | 2.2 | 165 | b |
| 3000 | 1.5 | 113 | a |

The thickness (in denier) of the undrawn bundle of filaments is selected so as to produce a drawn bundle of filaments having about 75 denier thickness, that is, the thickness of the undrawn bundle of filaments is chosen to be (75× natural draw ratio) in denier.

The natural draw ratio of the fibrous bundle melt-spun at a spinning speed of 1000 m/min is measured at various atmospheric temperatures in the drawing zone to obtain the results shown in Table 3.

TABLE 3

| Atmospheric Temperature (°C.) | Natural Draw Ratio | Curve in Fig. 8 |
|---|---|---|
| 25 | 3.2 | c |
| 70 | 3.2 | d |
| 80 | 2.4 | e |
| 90 | 1 | f |

From FIG. 8, it will readily be understood that a higher spinning speed results in a low natural draw ratio. Namely, the natural draw ratio can be set by appropriately selecting the spinning speed. This means that in a fibrous bundle obtained according to the method of this invention, the sectional area ratio of thick portions to thin portions in the constituent filaments can be appropriately selected. In this invention, the sectional area ratio of thick portions to thin portions in the constituent filaments is substantially in agreement with the natural draw ratio. For example, when the method of this invention is carried out by using filaments having a natural draw ratio of 2.0, there is obtained a fibrous bundle composed of filaments in which the sectional area of thick portions is about 2 times the sectional area of thin portions.

From FIG. 8, it will also be understood that the filaments show a constant tension elongation behavior at a temperature of 80° C. or lower, and the filaments do not show a constant tension elongation behavior at 90° C. At a temperature of 70° C. or lower, the natural draw ratio is clearly definite but at 80° C., the natural draw ratio is a little indefinite and unstable. This is due to the fact that the glass transition temperature is ordinarily observed between about 70° C. and about 80° C.

The presence of the frictional resistance-imparting member is the most important factor in the above-mentioned method in order to obtain the fibrous bundle of this invention.

The frictional resistance-imparting member has functions of making phases of drawing unevenness irregular among respective constituent filaments and remarkably diminishing pitches of drawing unevenness. Higher effects are obtained when the frictional resistance is higher or the distance between the frictional resistance-imparting member and the take-up roller is horter. When such frictional resistance-imparting member is not used, it is very difficult to obtain a fibrous bundle where high dyeability portions of fibrous elements are present at a distribution ratio of at least 300 portions per 10 cm of the length of the fibrous bundle. The inventors of the present invention have found that it is very important that the frictional resistance-imparting member should be disposed so that the fibrous bundle is caused to fall in contact with the take-up roller in the yarn passage at a point distant by 50 mm or less from the point where the fibrous bundles left from the frictional resistance-imparting member, namely the drawing distance is 50 mm or less.

Figure 9A:
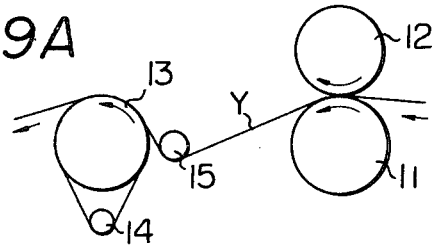
FIGS. 9A, 9B and 9C are schematic side views illustrating the main part of the drawing zone, which illustrate embodiments of the method of this invention.

Referring to FIG. 9A, a filament bundle Y is fed by feed rollers 11 and 12, is caused to fall in contact with a frictional resistance-imparting member 15 and is bent by the member 15. Then, the bundle Y is taken up by a take-up roller 13 to effect drawing of the bundle Y. Reference numeral 14 represents a separate roller.

Figure 9B:
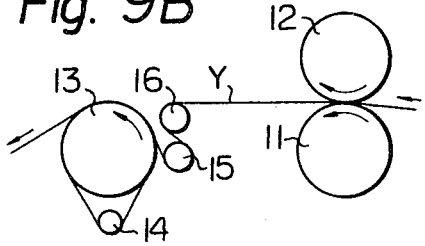
Figure 9C:
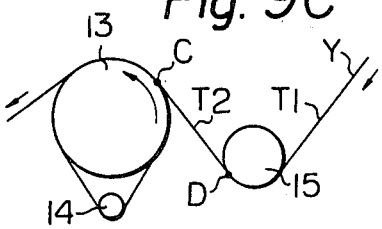

The material and shape of the frictional resistance-imparting member are not particularly critical so long as when the running fibrous bundle is caused to fall in contact with the frictional resistance-imparting member while being bent thereby, the tension on the fibrous bundle upstream of the frictional resistance imparting-member is lower than the tension on the fibrous bundle downstream of the frictional resistance-imparting member. Of course, this frictional resistance-imparting member is required to have long durability. As a result of investigations, the inventors found that a pin-like frictional resistance-imparting member 15, as shown in FIGS. 9A, 9B and 9C, is ordinarily preferred and is readily available. Such factors as the frictional resistance force and the bending contact length are optionally selected independently according to the material, surface condition, surface curvature and contact angle of the frictional resistance-imparting member. The frictional resistance-imparting member need not be composed of a single material but it may be composed of a plurality of different material members 15 and 16 as shown in FIG. 9B.

Figure 10:
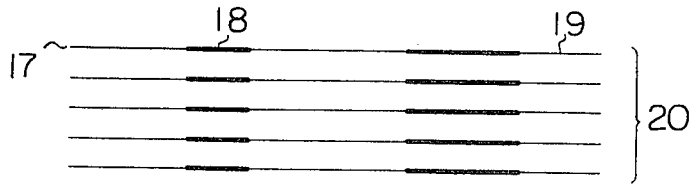
FIG. 10 is a diagrammatic view illustrating the state of formation of thick portions and thin portions of fibrous elements in a comparative fibrous bundle, which is obtained without using the frictional resistance-imparting member.
Figure 11:
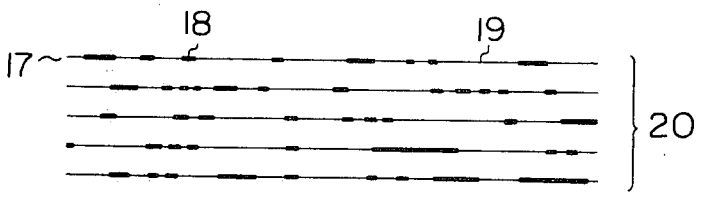
FIG. 11 is a diagrammatic view illustrating the state of formation of thick portions and thin portions of fibrous elements in a fibrous bundle, which is obtained according to this invention.

When the above mentioned drawing operation is carried out without using a particular frictional resistance-imparting member, in a produced fibrous bundle 20 there is observed a tendency that phases of undrawn portions 18 and drawn portions 19 distributed along the lengthwise direction are respectively regularly arranged in constituent filaments as shown in FIG. 10. In contrast, if the frictional resistance-imparting member is disposed according to this invention, phases of undrawn portions 18 and drawn portions 19 distributed along the lengthwise direction are respectively surprisingly made irregular in constituent filaments as shown in FIG. 11, and great numbers of drawn portions and undrawn portions are formed with very short pitches.

Figure 12:
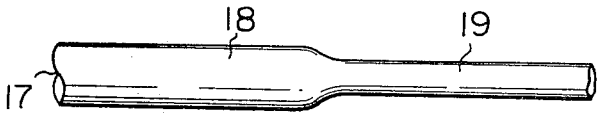
FIG. 12 is a schematic side view of a fibrous element illustrating thick portions, i.e., undrawn portions, and thin portions, i.e., drawn portions, in the fibrous bundle of this invention.

More specifically, when a filament bundle provided with a characteristic feature of constant tension elongation behavior within the specific temperature range is drawn at a temperature within said specific temperature range under a draw ratio lower than the natural draw ratio, there is obtained a fibrous bundle of filaments 17, in each of which substantially undrawn portions 18 (undrawn portions) and portions 19 drawn at a ratio substantially equal to the natural draw ratio (drawn portions) are formed in the state clearly discerned from each other as shown in FIG. 12.

The method of this invention is based on the finding of the above specific drawing phenomenon caused under the above-mentioned specific conditions.

The histogram showing the state of distrubution of sectional areas of filaments on a certain section of a filament bundle obtained according to the method including the above-mentioned specific drawing step includes two peaks as diagrammatically shown in FIG. 3B. Even if this filament bundle is subjected to the false-twisting treatment described hereinafter and the sections of the filaments are flattened to some extent, this characteristic feature is maintained as shown in FIG. 3A.

In the fibrous bundle of this invention, the undrawn portions are thick portions and the drawn portions are thin portions. Accordingly, the drawing action imposed on the thick portions is much smaller than the drawing action imposed on the thin portions. Therefore, the degree of molecular orientation in the thick portions is ordinarily lower than in the thin portions and the thick portions ordinarily have a higher dyeability than the thin portions.

Accordingly, if the so prepared fibrous bundle of this invention is further drawn, the thick portions are first drawn preferentially until the size is reduced to a level substantially equal to the size of the thin portions, and then, the fibrous bundle is continued to be drawn and finally broken. This is a peculiar drawing behavior characteristic of the fibrous bundle of this invention.

The reasons thick portions and thin portions of constituent filaments are distributed in such randomly mingled conditions in a fibrous bundle prepared according to the method of this invention including the above-mentioned specific drawing step are considered to be as follows.

Upstream of the frictional resistance-imparting member a tension causing drawing is not substantially generated and actual drawing is effected only downstream of the frictional resistance-imparting member. Therefore, the actual drawing distance is short. Further, a frictional resistance-imparting member having a size much smaller than that of the feed roller may be used and it is possible to bring the frictional resistance-imparting member very close to the take-up roller. Therefore, very short thick portions and very short thin portions are formed in respective constituent filaments. Further, while the fibrous bundle as a whole is flattened or opened on the frictional resistance-imparting member, drawing is performed, and the drawing action is imposed on respective filaments. Accordingly, a very desirable distribution state of thick and thin portions of the constituent filaments can be attained in the fibrous bundle.

When the drawing distance (the distance of the yarn passage between the frictional resistance-imparting member and the take-up roller) is compared in detail with the length of thick portions and the length of thin portions, it is seen that the length of either the thick portions or the thin portions is very short and is about 1/10 to about 1/100 of the drawing distance. This feature cannot be sufficiently rationalized by the above illustration. Therefore, as additional reasons, the following may be considered. Scratches acting as the origin of drawing necks are formed by the rubbing action of the frictional resistance-imparting member, or the temperature of the frictional resistance-imparting member is elevated by the heat of friction or drawing so that the actual drawing is performed at a position only adjacent to the frictional resistance-imparting member. Further, the fibrous bundle is drawn while stick-slip is being caused in the fibrous bundle. At any rate, it is construed that, for some particular combination of some of the above-mentioned reasons, according to this invention, there is obtained a fibrous bundle in which respective constituent fibrous elements comprise great numbers of thick portions and thin portions randomly mingled in a good distribution state, so that the thickness of the fibrous bundle as a whole is substantially uniform.

The uniformity of the distribution of thick and thin portions of fibrous elements throughout the entire fibrous bundle is especially improved when the drawing distance is short, and particularly when it is shorter than 50 mm. Further, it is preferred that the passage resistance imposed on the fibrous bundle by the frictional resistance-imparting member be large. It also is preferred that the tension imparted to the fibrous bundle in the upstream of the frictional resistance-imparting member be less than 70% of the tension imparted to the fibrous bundle in the downstream of the frictional resistance-imparting member, i.e., the drawing-initiating tension.

From the viewpoint of the uniformity of the distribution state of thick and thin portions of constituent fibrous elements in the fibrous bundle, it is preferred that the average value of the number proportion $l_i$ of high dyeability portions observed in a certain section of the fibrous bundle, i.e., the value of $$\frac{\sum_{i=1}^{M} l_i}{M},$$

be in the range of from 35 to 65%. This value can be appropriately set by appropriately adjusting the relation between the natural draw ratio of filaments supplied and the draw ratio adopted at the drawing step of the method of this invention. More specifically, a fibrous bundle excellent in the above-mentioned uniformity can be obtained when the following relation is established between the draw ratio r (take-up speed/feed speed) at the drawing step and the natural draw ratio R, $$\frac{100R}{35 = 65R} < r < \frac{100R}{65 + 35R}$$

The inventors have found that a good thick-thin effect is attained when the ratio of the average sectional area of thick portions to the average sectional area of thin portions in constituent fibrous elements is in the range of 1.3 to 2.2, and; that if this ratio is lower than 1.3, the effect is insufficient, and if this ratio is higher than 2.2, the above-mentioned uniformity is degraded. In short, the thick-thin effect of this invention is especially prominent when the inherent natural draw ratio R of the supplied fibrous elements is in the range:

$$1.3 \leqq R \leqq 2.2$$

Further, the thick-thin effect is particularly prominent when polyester filaments are used. As described hereinbefore with respect to Table 2, polyethylene terephthalate is melt-spun and fibrous bundles composed of 36 filaments are taken up at various spinning speeds, and the natural draw ratios of these fibrous bundles are measured at an atmospheric temperature of 25° C., to obtain the results show in Table 4.

TABLE 4

| Spinning Speed (m/min) | Size of Undrawn Fibrous Bundle (denier) | Natural Draw Ratio |
|---|---|---|
| 1000 | 240 | 3.20 |
| 1500 | 196 | 2.61 |
| 2000 | 165 | 2.20 |
| 2500 | 137 | 1.82 |
| 3000 | 113 | 1.51 |
| 3500 | 100 | 1.33 |
| 4000 | 95 | 1.27 |

From Table 4, it will readily be understood that, in the case of the above-mentioned polyester filaments, the thick-thin effect of this invention is especially prominent when the spinning speed is in the range of about 2000 to about 3500 m/min.

In the method of this invention, good results are obtained when the fibrous bundle which has passed through the above-mentioned specific drawing step is subjected to a fluid treatment to entangle the constituent filaments with one another by jet streams of a fluid.

When a bundle composed of filaments having thick and thin portions, prepared according to the above-mentioned drawing operation, is subjected to a heat treatment, the thick undrawn portions are thermally embrittled and these portions become weak portions. The fibrous bundle can easily be converted to a fibrous bundle including cut ends by utilizing these weak portions. In this case good results are obtained if the constituent filaments are entangled and gathered by the above-mentioned fluid treatment prior to the heat treatment forming thermally embrittled weak portions.

Namely, in the method of this invention, if the heat treatment is carried out after the above-mentioned drawing operation or fluid treatment, the thick portions can be embrittled and it is possible to cause differences of strength and elongation between the thick and thin portions. If such differences of strength and elongation are brought about, cutting of the constituent filaments is caused at random points in the fibrous bundle, and there can be obtained a fibrous bundle having a desirable appearance and hand quality quite similar to those of a spun yarn. Thick portions characterized by a low degree of molecular orientation are readily thermally embrittled. The ultimate object of this invention is to obtain such a fibrous bundle which includes fibrous elements having cut ends.

A heat treatment accompanying a drawing operation is preferred as the above-mentioned heat treatment. By this drawing operation, the thick portions of filaments are thermally embrittled and rendered weak and cut. It is preferred that this heat treatment be carried out in a false-twisting zone where the fibrous bundle is false-twisted.

In order to improve the gathering property of the heat-treated fibrous bundle to be subjected to the subsequent processing steps, it is preferred that the heat-treated fibrous bundle be treated by jet streams of a fluid to entangle the constituent filaments with one another. Such entanglements may be produced continuously or intermittently along the lengthwise direction of the fibrous bundle. When entangled portions and unentangled portions are formed alternately, as pointed out hereinbefore, especially good results are obtained if at least 30 of the entangled portions are present per meter of the length of the fibrous bundle.

FIGS. 13A to 13D illustrate embodiments of the above-mentioned steps subsequent to the drawing step.

In each of these embodiments, the heat treatment is carried out in a false-twisting zone. Reference numerals 23 and 24 represent a false twisting device and a false-twisting heater, respectively.

Figure 13A:
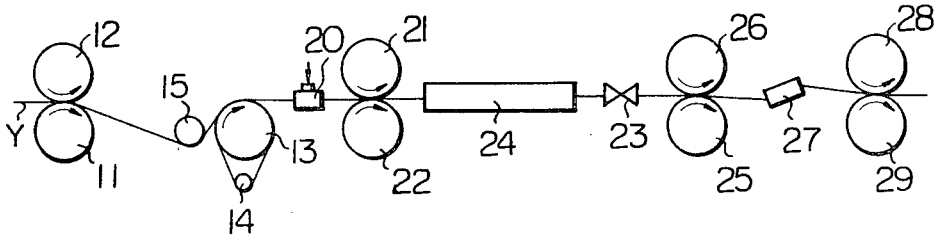
FIGS. 13A to 13D are schematic side views illustrating embodiments of the downstream steps subsequent to the drawing step shown in FIGS. 9A to 9C, which are adopted in this invention.
Figure 13B:
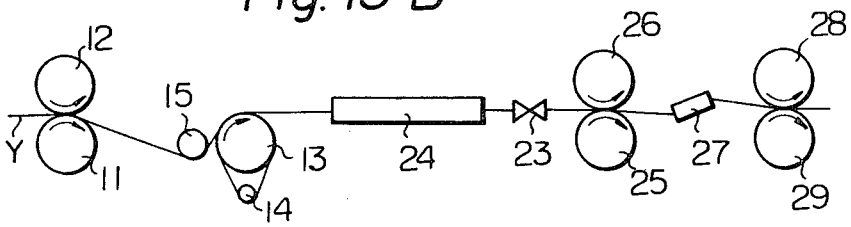
Figure 13C:
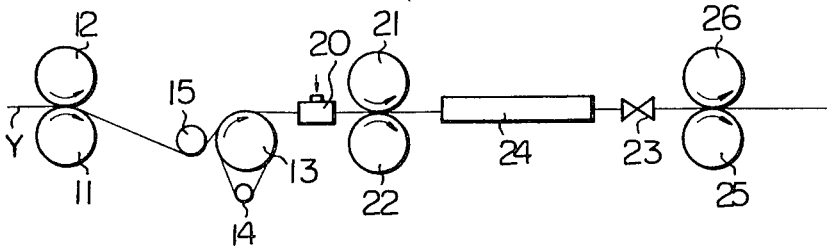

In the embodiments illustrated in FIGS. 13A and 13C, the entanglement treatment is carried out by using a fluid treatment device 20 prior to the heat treatment, and in the embodiments illustrated in FIGS. 13A and 13B, the entanglement is carried out by using a fluid treatment device 27 disposed at a position after the heat treatment. In the embodiment shown in FIG. 13D, the entanglement treatment is not carried out either before or after the heat treatment. In FIGS. 13A to 13D, each of the reference numerals 21, 22, 25, 26, 28 and 29 represents yarn feed rollers, respectively.

This after treatments conducted after the above-mentioned specific drawing operation to produce cut ends in constituent filaments of the fibrous bundle are not limited to the embodiments specifically illustrated in FIGS. 13A to 13D, but various modifications can be made.

The embodiment in which the heat treatment is carried out in a false-twisting zone exerting a drawing action is especially preferred because the after-treatment is simplified and the apparatus need not be complicated. In this embodiment, the draw ratio and heat treatment temperature in the false-twisting zone are important factors for generating cut ends of fibrous elements in the fibrous bundle, and these conditions should be appropriately set in combination after due consideration of conditions of other treatments, especially treatments conducted after this false-twisting operation. For example, when the fluid treatment is carried out after the false-twisting treatment, since the fibrous elements are cut also by this fluid treatment, it is necessary to perform the false-twisting treatment under such conditions that the cutting action in the false-twisting zone is not too violent. Of course, breakage of fibrous elements takes place also when the fibrous bundle is formed in a knitted or woven fabric. At any rate, as described hereinbefore, it is preferred that the fibrous bundle should have at least 10 cut ends per meter of the length of the fibrous bundle.

Figure 13D:
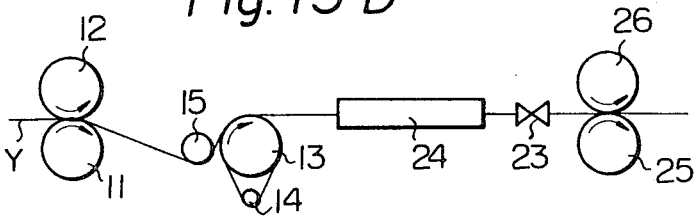

As a result of investigations, it was found that in an embodiment where the entanglement treatment is not conducted after the false-twisting heat treatment as shown in FIGS. 13C and 13D, if the draw ratio $R_2$ at this false-twisting heat treatment is adjusted so that the following relation is established among this draw ratio, the draw ratio r at the step for forming the thick and thin portions in the fibrous elements and the natural draw ratio R:

$$\frac{58R+42}{100r} < R_2 < \frac{R}{r}$$

there can be obtained a fibrous bundle which is very easy to handle. This is because weak points are formed in the fibrous elements constituting the fibrous bundle but the constituent fibrous elements are still kept unbroken at these weak points. In order to obtain a fibrous bundle which is easy to handle, it also is preferred that the following relation be established between the false-twisting heat treatment temperature $T_1$ (°C.) and the melting point Mp (°C.) of the fibrous elements:

$$Mp-40 < T_1 < Mp-10$$

If this requirement is satisfied, there is obtained a fibrous bundle in which the constituent fibrous elements are lightly gathered by insufficient detwisting, fusion bonding or the like and a great number of cut ends will appear at the knitting or weaving step.

In the case where the fluid treatment is carried out after the false-twisting heat treatment as shown in FIGS. 13A and 13B, if either of the two following heat treatment temperatures is adopted, it is possible to adjust the number of cut ends appropriately in constituent fibrous elements of the resulting fibrous bundle.

When the false-twisting heat teatment temperature $T_2$ (°C.) (the first preferred temperature) is adjusted within a range defined by the formula of $Mp-40<T_2<Mp-20$, and especially when the draw ratio $R_2$ at the false-twisting heat treatment is adjusted so that the requirement of $$\frac{75R+25}{100r} < R_2 < \frac{R}{r}$$

is satisfied, since the heat treatment temperature is relatively high and the degree of thermal embrittlement is increased, there is obtained a fibrous bundle having a good gathering property and having a great number of cut ends in fibrous elements. Further, if the following relation is established between the false twist number TW (twists per meter) and the thickness D (denier) of the fibrous bundle at the false-twisting heat treatment step:

$$\frac{18000}{\sqrt{D}} < TW < \frac{29000}{\sqrt{D}}$$

there can be obtained a fibrous bundle having a great number of cut ends in the constituent fibrous elements and a good gathering property.

When the false-twisting heat treatment temperature $T_3$ (°C.) (the second preferred temperature) is adjusted within a range of $T_3<(Mp-40)$, and especially when the draw ratio $R_2$ at the false-twisting heat treatment is adjusted so that the requirement of $$\frac{75R+25}{100r} < R_2 < \frac{125R-25}{100r}$$

is satisfied, there can be obtained a fibrous bundle in which the number of cut ends in the constituent fibrous elements is relatively small but the gathering property is good. This fibrous bundle is advantageously applied to the end-use where a fabric formed of this fibrous bundle is subjected to a raising treatment to form fluffs.

[Apparatus according to the present invention]

The fibrous bundle of this invention can be produced at a high efficiency by a fiber processing apparatus characterized by a specific drawing mechanism, which is hereinafter described.

More specifically, the fibrous bundle of this invention is advantageously prepared by a fiber processing apparatus provided with a drawing device. This apparatus is characterized in that the drawing device comprises a frictional resistance-imparting member having a pin-like shape and a drawing roller, the central axis of the frictional resistance-imparting member having a pin-like shape is substantially in parallel to the central axis of the drawing roller, and the following relation is established between the frictional resistance-imparting member and the drawing roller:

$$d_3^2+d_3(d_1+d_2)\leqq 50^2$$

wherein $d_1$ stands for the diameter (mm) of the frictional resistance-imparting member having a pin-like shape, $d_2$ stands for the diameter (mm) of the drawing roller, and $d_3$ stands for the distance (mm) between the drawing roller and the frictional resistance-imparting member.

Figure 14:
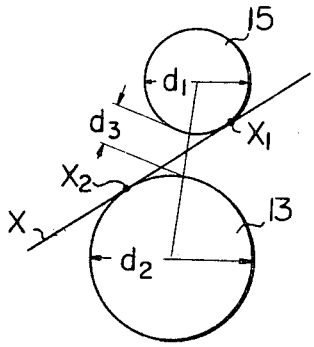
FIG. 14 is a schematic side view of a part of a drawing mechanism in the apparatus according to the present invention.

The drawing roller mentioned above is a take-up roller represented by reference numeral 13 in FIGS. 9A to 9C and 13A to 13D. The relation represented by the above formula indicates that, when a common inscribed tangential line X of the frictional resistance-imparting member 15 and the drawing roller 13, and the points of contact of the frictional resistance-imparting member 15 and the drawing roller 13 with the imaginary common inscribed tangential line X are designated as $X_1$ and $X_2$, respectively, as shown in FIG. 14, the distance between $X_1$ and $X_2$ is 50 mm or less. This distance between $X_1$ and $X_2$ is the drawing distance, and, as pointed out hereinbefore, an especially excellent fibrous bundle is obtained when this distance is 50 mm or less.

In the case of utilizing a pair of frictional resistance imparting members such as pins 15, 16 shown in FIG. 9B, it is necessary to satisfy the above-mentioned relation by the member disposed at a downstream position, that is the pin 15. The material constituting the frictional resistance-imparting member is appropriately selected from for example, various mirror-polished metals, various satinized metals and various ceramic materials differing in the surface roughness, and; factors such as the frictional resistance force and the like are taken into account in selecting the material constituting the frictional resistance-imparting material. Of course, the frictional resistance force may also be adjusted by controlling the contact angle of the fibrous bundle with the frictional resistance imparting member.

In the apparatus of this invention, it is important that the drawing distance should be 50 mm or less. In order to attain this feature, the frictional resistance-imparting member having a pin-like shape is disposed at a position very close to the drawing roller.

If the drawing distance is changed in the widthwise direction of the frictional resistance-imparting member and the stretch roller according to the position of engagement with the fibrous bundle, no good results are obtained because uniform characteristics are not created in the processed fibrous bundle. In view of this fact, it is most preferred that the frictional resistance-imparting member be completely in parallel to the drawing roller. We found that even if there is some difference in the drawing distance in the actual operation, if such difference is within 15% of the drawing distance, the resulting fibrous bundle can be regarded as being substantially uniform in the characteristics features thereof. Accordingly, in this invention, by the term "substantially in parallel" is meant such positional relationship between the frictional resistance-imparting member and the drawing roller as will control the difference in the drawing distance to within 15%.

In the conventional drawing apparatus provided with drawing pin, the central axis of the drawing pin is ordinarily arranged to cross the central axis of the drawing roller at right angles.

Figure 15:
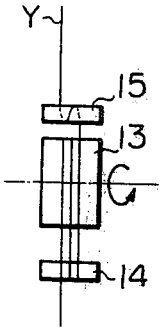

In the case where the fibrous bundle Y is turned around the frictional resistance-imparting member 15 as shown in FIG. 15, if the central axis of the frictional resistance-imparting member 15 is completely in parallel to the central axis of the drawing roller 13, the wound filaments overlap one another and movement of the fibrous bundle Y is inhibited. In this case, it is, therefore, preferred that the central axis of the frictional resistance-imparting member 15 be inclined with respect to the central axis of the drawing roller 13 to such an extent that overlapping of wound filaments can be prevented. In this case, it is preferred that the frictional resistance-imparting member 15 and the drawing roller 13 be inclined in distorting directions, because the change of the drawing distance is then maintained at a minimum level.

Figure 16A:
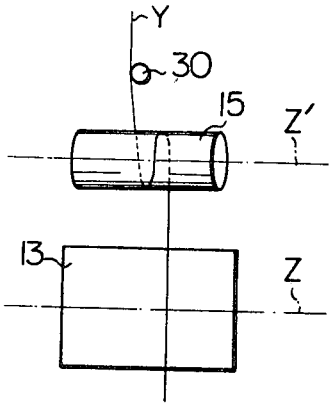
FIGS. 15, 16A and 16B are schematic front views of a drawing mechanism in the apparatus of this invention, respectively.
Figure 16B:
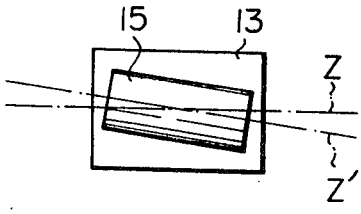

FIGS. 16A and 16B are views diagrammatically illustrating the positional relationship between the frictional resistance-imparting member 15 and the drawing roller 13. FIG. 16A is a positive projection of the drawing roller and frictional resistance-imparting member to an imaginary plane defined by the central axis Z of the drawing roller 13 and the central point of the central axis Z' of the frictional resistance-imparting member 15, and; FIG. 16B is a positive projection seen from the direction of the plane of FIG. 16A. In FIG. 16A, the lines Z and Z' are parallel to each other, but in FIGS. 16B, the lines Z and Z' cross each other.

When the frictional resistance-imparting member 15 and the drawing roller 13 are inclined to each other as shown in FIGS. 16A and 16B, even if the fibrous bundle Y is turned around the frictional resistance-imparting member 15, overlapping of wound filaments can be prevented while the change in the drawing distance can be restricted to a small value.

If the distance between the drawing roller and the frictional resistance-imparting member is too narrow in the apparatus of this invention, when drawn filaments are wound and entangled on the drawing roller during the drawing operation, there is a risk that the apparatus will be destroyed or damaged. If the frictional resistance-imparting member is arranged so that it is movable in the direction away from the drawing roller, the above mentioned risk can be eliminated and the actual operation can be performed very conveniently.

When the fibrous bundle to be drawn is turned around the frictional resistance-imparting member, the yarn passage often becomes unstable. This disadvantage can be eliminated if a yarn guide 30 is disposed upstream of the frictional resistance-imparting member 15 as shown in FIG. 16A. From the viewpoint of the actual operation, it is preferred that this yarn guide be arranged so that it will also serve as a traverse guide.

A material having a large coefficient of friction is preferably used as the material constituting the drawing roller 13. For example, mirror-polished hard chromium-plated iron is suitable as the material of the drawing roller. In each of the figures there is shown an embodiment in which the fibrous bundle is turned around a separate roller 14 as well as the drawing roller 13. Of course, the apparatus of this invention is not limited to this embodiment, and the roller nip system, the apron roller nip system and the like can be effectively adopted.

As will be apparent from the above-mentioned illustration, respective fibrous elements of a fibrous bundle are not fibrous elements having a high dyeability characteristic along the entire length or fibrous elements being poor dyeable along the entire length. Namely, fibrous elements according to the present invention include high dyeability portions randomly created along the lengthwise direction thereof. Therefore, the above-mentioned high dyeability portions of the fibrous elements are randomly distributed in the fibrous bundle along the lengthwise direction thereof. In other words, when such fibrous bundle is dyed, the densly dyed portions of the fibrous elements are randomly distributed in the fibrous bundle along the lengthwise direction thereof. Consequently, if such dyed fibrous bundle is randomly cut at any lengthwise positions, and the cut sections are observed by means of a microscope, it can be recognized that, in any cut sections, the densly dyed elements corresponding to the above-mentioned high dyeability portions and the lightly dyed elements exist in a mixed condition.

If constituent fibrous elements of a fibrous bundle have already been dyed, the high dyeability portions can easily be recognized by examination of the fibrous bundle. If the fibrous bundle is not dyed, an optional dyeing method can be adopted for confirmation of the presence of such high dyeability portions. However, in order to clearly discern between dark and light color effects, it is preferred to use a heterogeneous dye (a dye having a large molecular weight) for the examination. For example, Eastene-Rubine-R (a product of Eastman Kodak) is used as the dye and the dye concentration, dyeing time, temperature and other conditions are appropriately decided on depending on the bundle-constituting fibrous material and the treatments which the fibrous bundle has passed through. In the fibrous bundle of this invention, since there is a difference in the degree of molecular orientation between thick portions and thin portions of fibrous elements, definite light and shade can be clearly discerned on dyeing.

The present invention will now be described in detail by reference to the following Examples that by no means limit the scope of the invention.

EXAMPLE 1

Polyethylene terephthalate was melt-spun and taken up at a speed of 2500 m/min to prepare a 330-denier undrawn fibrous bundle of 48 filaments, a so-called "multifilament yarn". The natural draw ratio R of this undrawn fibrous bundle was 1.9 as measured at 25° C. This fibrous bundle was drawn according to the embodiment shown in FIG. 9A to form a fibrous bundle composed of fibrous elements having uneven thickness. Detailed drawing conditions were as follows.

- Feed speed (speed of feed rollers 11 and 12): 355 m/min
- Take-up speed (speed of take-up roller 13): 500 m/min
- Draw ratio r: about 1.41
- Frictional resistance-imparting member:
  - diameter $d_1 = 10$ mm, hollow iron pipe plated with hard chromium, satinized surface
- Distance $d_3$ between take-up roller and frictional resistance-imparting member: 5 mm
- Diameter $d_2$ of take-up roller: 72 mm
- Bending contact angle of fibrous bundle to frictional resistance-imparting member: 800°
- Drawing distance: about 20.9 mm
- Tension on fibrous bundle upstream of frictional resistance-imparting member: about 10 g
- Tension on fibrous bundle downstream of frictional resistance-imparting member: about 130 g (estimated)
- Temperature of frictional resistance-imparting member: 48° C.
- Temperature of drawing atmosphere: 25° C.

In the respective constituent filaments of the so obtained fibrous bundle, thick portions having a length of about 0.3 to about 3 mm and thin portions having a similar length were very randomly distributed in the lengthwise direction of the filaments and in the sectional direction of the fibrous bundle. When the fibrous bundle was dyed and the number of the high dyeability portions was examined, it was found that the number of said portions was about 4000 per 10 cm of the length of the fibrous bundle.

Fifty sections of the fibrous bundle were collected by random sampling at intervals of 1 to 5 m with respect to the lengthwise direction, and they were analyzed. It was found that groups of thick portions having a large sectional area and thin portions having a small sectional areas were distributed in the state discriminated from each other (namely, the distribution state as shown in FIG. 3B was observed). The coefficient of variation of the number proportion of the high dyeability elements corresponding to the high dyeability portions, in the section of the fibrous bundle was 30%.

In the analysis, it was found that the boundary sectional area value B was about 430 $(\mu m)^2$, the average value $A_L$ of the sectional areas of the thick portions was about 560 $(\mu m)^2$ and the average value $A_S$ of the sectional areas of the thin portions was about 300 $(\mu m)^2$.

The number of fibrous elements having a sectional area within the range of from $(B+A_S)/2$ to $(B+A_L)/2$ was about 0.8% of the total number of the fibrous elements.

Further, the coefficient of variation of the number proportion of the fibrous elements included in the thick sectional area group in the section of the fibrous bundle was less than 30%.

The number of the fibrous elements included in the thick sectional area group was 37.9% of the total number of the observed fibrous elements.

The resulting fibrous bundle had an appearance quite similar to that of a fibrous bundle composed of filaments uniform in the thickness.

EXAMPLE 2

The fibrous bundle prepared in Example 1 was subsequently subjected to the false-twisting treatment and, then, to the fluid treatment to obtain a false-twisted textural yarn. Namely, the fibrous bundle prepared in Example 1 was processed according to the embodiment shown in FIG. 13B.

The false-twisting heat treatment temperature was 230° C. and the draw ratio $R_2$ at the false-twisting heat treatment was 1.3. False twisting was conducted according to the friction system.

Sections of the constituent filaments in the section of the resulting yarn were examined in the same manner as described in Example 1. It was found that the sectional area distribution characteristics observed in Example 1 were substantially retained in the resulting yarn.

Further, the yarn obtained in this Example was found to have 50 cut ends of the filaments per meter of the length of the yarn.

Values obtained in Example 2 were:

B: about 390 $(\mu m)^2$ $A_S$: 290 $(\mu m)^2$ $A_L$: 470 $(\mu m)^2$

Number proportion of high dyeability portions: 22%

Number proportion of thick portions: 18.6%

Coefficient of variation of number proportion of high dyeability portions: 8.2%

Coefficient of variation of number proportion of thick portions: 11%

Number proportion of fibrous elements having sectional area in range of from $(B+A_S)/2$ to $(B+A_L)/2$: 7.2%

The distribution state of groups of thick portions and thin portions of the filaments in the section of the resulting yarn was as shown in FIG. 3A.

EXAMPLE 3

According to the embodiment shown in FIG. 13D, the fibrous bundle obtained in Example 1 was subsequently false-twisted to obtain a false-twisted fibrous bundle.

The false-twisting heat treatment temperature was 230° C. and the draw ratio $R_2$ at the false-twisting heat treatment was 1.17. False twisting was conducted according to the friction system.

In the same manner as described in Example 1, the distribution state of sectional areas of the fibrous elements in the section of the fibrous bundle was examined. It was found that the results of examination of the distribution state were substantially the same as the results obtained in Example 2.

In the fibrous bundle obtained in this Example, the fibrous elements were lightly fusion-bonded to one another (to such an extent that they could easily be separated from one another). A double jersey cloth (22G interlock) was prepared by using the so prepared fibrous bundle. In the fibrous bundle formed in the jersey cloth, the number of the fusion-bounded portions was decreased, and it was found that a great number of fluffs were formed on the jersey cloth. When the jersey cloth was deknitted, it was found that there were present about 70 cut ends of filaments per meter of the length of the fibrous bundle. Thus, it was confirmed that the above mentioned jersey cloth had an appearance and hand quality resembling those of an ordinary raised jersey cloth.

EXAMPLE 4

According to the embodiment shown in FIG. 13B, the fibrous bundle obtained in Example 1 was subsequently subjected to the false-twisting treatment and, then, to the fluid treatment to obtain a false-twisted fibrous bundle.

The false-twisting heat treatment temperature was 205° C. and the draw ratio $R_2$ at the false-twisting heat treatment was 1.35. False twisting was conducted according to the friction system.

The distribution state of sectional areas of the fibrous elements in the section of the fibrous bundle was analyzed in the same manner as described in Example 1. The obtained results were substantially the same as the results obtained in Example 2.

The obtained fibrous bundle had an appearance resembling that of an ordinary false-twisted yarn (no fluffs but entanglements). A woven fabric constituted by:

Structure of fabric: 2/2 twill weave

Width of woven fabric: 172 cm

Warp yarn density: 89/inch

Picks/inch: 76/inch

Thickness of the bundle of filaments: 175/48f was produced from this false-twisted fibrous bundle and the woven fabric was subjected to a raising treatment (buff processing). Raising could be accomplished very easily and uniformly. Namely, the processing time required was about ¼ of the processing time required in the case of a woven fabric of the same standard produced from an ordinary false-twisted yarn.

What we claim is:

1. A fibrous bundle composed of a plurality of fibrous elements, wherein at least a partial number of said fibrous elements have a sectional area varying in the axial direction thereof, thick portions of each fibrous element having lengthwisely varying thickness are generally provided with a higher dyeability than thin portions of said fibrous elements, said high dyeability portions being present randomly at a distribution ratio of at least 300 portions per 10 cm of the length of the fibrous bundle and the coefficient of variation of the number proportion of the high dyeability elements corresponding to said high dyeability portions in the section of the fibrous bundle being less than 50%.

2. A fibrous bundle according to claim 1 wherein the sectional areas of the fibrous elements constituting the fibrous bundle in the section of the fibrous bundle are distributed so that groups of thick sectional area portions and thin sectional area portions are capable of discerning from each other.

3. A fibrous bundle according to claim 2 wherein the sectional areas of the fibrous elements constituting the fibrous bundle in the section of the fibrous bundle are distributed so that the number of fibrous elements having a sectional area within a range of from [(boundary sectional area value)+(average value of sectional areas of portions of thick sectional area group)]/2 to [(boundary sectional area value)+(average value of sectional areas of portions of thin sectional area group]/2 is less than 10% of the total number of the fibrous elements present in said section of the fibrous bundle.

4. A fibrous bundle according to claim 2 wherein the coefficient of variation of the number proportion of the portions of the thick sectional area group in the section of the fibrous bundle is less than 50%.

5. A fibrous bundle according to claim 2 wherein the number of the fibrous elements having a sectional area included in the thick sectional area group in the section of the fibrous bundle is 10 to 70% of the total number of the fibrous elements present in said section of the fibrous bundle.

6. A fibrous bundle according to claim 2 wherein the ratio of the average value of sectional areas of the thick portions to the average value of sectional areas of the thin portions is in the range of from 1.3 to 2.2.

7. A fibrous bundle according to claim 1 wherein the fibrous elements constituting the fibrous bundle have crimps formed by false twisting treatment.

8. A fibrous bundle according to claim 7, wherein the sectional shape of the thick portions of the fibrous elements constituting the fibrous bundle possesses a degree of flattening higher than in the sectional shape of the thin portions of the fibrous elements and the number of the portions of the fibrous elements having a flat sectional portion is at least 10% of the total number of the portions of the fibrous elements, said flat sectional portion being a portion of a fibrous element having a section of a maximum diameter value not smaller than the boundary maximum diameter value.

9. A fibrous bundle according to claim 7, wherein the fibrous elements are gathered together at least partially in the fibrous bundle.

10. A fibrous bundle according to claim 9, wherein the fibrous elements constituting the fibrous bundle comprise entangled portions and unentangled portions formed alternately along the lengthwise direction of the fibrous bundle, and at least 30 entangled portions are present per meter of the length of the fibrous bundle.

11. A fibrous bundle according to claim 7, wherein at least 10 cut ends of said fibrous elements are present per meter of the length of the fibrous bundle.

12. A fibrous bundle according to claim 1, wherein the fibrous elements are continuous fibrous elements.

13. A fibrous bundle according to claim 1, wherein the fibrous elements are discontinuous fibrous elements.

14. A fibrous bundle according to claim 1, wherein the fibrous elements include both continuous fibrous elements and discontinuous fibrous elements.

* * * * *